US006312762B1

(12) United States Patent
Sugawara et al.

(10) Patent No.: US 6,312,762 B1
(45) Date of Patent: Nov. 6, 2001

(54) PROCESS FOR PRODUCTION OF COPPER OR COPPER BASE ALLOYS

(75) Inventors: Akira Sugawara; Yoshitake Hana, both of Toyooka-mura; Takayoshi Endo, Haibara, all of (JP)

(73) Assignees: Dowa Mining Co., Ltd.; Yazaki Corporation, both of Tokyo (JP)

( * ) Notice: Subject to any disclaimer, the term of this patent is extended or adjusted under 35 U.S.C. 154(b) by 0 days.

(21) Appl. No.: 09/496,697

(22) Filed: Feb. 2, 2000

(30) Foreign Application Priority Data

Feb. 3, 1999 (JP) ..... 11-63760

(51) Int. Cl.[7] ..... B05D 3/02; C23C 28/00; C23C 8/06; C25D 5/50

(52) U.S. Cl. ..... 427/376.2; 427/376.3; 427/376.4; 205/225; 205/226; 205/228; 205/224; 148/276; 148/282; 148/284; 148/512; 148/680; 148/433

(58) Field of Search ..... 148/276, 282, 148/284, 512, 680, 433; 427/58, 376.2, 376.3, 376.4; 205/50, 225, 226, 228, 224, 300

(56) References Cited

U.S. PATENT DOCUMENTS 4,511,410 * 4/1985 Shapiro et al. ..... 148/13.2
5,166,607 * 11/1992 Long ..... 324/158 F
5,262,022 * 11/1993 Tench et al. ..... 204/153.1

FOREIGN PATENT DOCUMENTS 834602 4/1998 (EP) .
2112419 7/1983 (GB) .
2-173294 4/1990 (JP) .
7-126779 5/1995 (JP) .

OTHER PUBLICATIONS

Patent Abstracts of Japan, vol. 1995, No. 08, Sep. 29, 1995 of JP 7–126779.
Chemical Abstracts, vol. 114, No. 8, Feb. 25, 1991, abstract No. 71153; XP 002137105 of JP 2–173294.

* cited by examiner

*Primary Examiner*—Edna Wong
(74) *Attorney, Agent, or Firm*—Frishauf, Holtz, Goodman, Langer & Chick, P.C.

(57) ABSTRACT

A process for the production of copper or a copper base alloy that provides a surface having improved characteristics suitable for the production of a connector or a charging-socket of an electric automobile by having a decreased coefficient of friction on the surface and improved resistance to abrasion. The process comprises coating copper or a copper alloy with Sn, followed by heat treating the resulting Sn-plated copper or copper base in an atmosphere having an oxygen content of no more than 5%, thereby forming on an outermost surface thereof an oxide film and beneath the surface a layer of an intermetallic compound mainly comprising Cu—Sn.

14 Claims, 1 Drawing Sheet

PROCESS FOR PRODUCTION OF COPPER OR COPPER BASE ALLOYS

BACKGROUND OF THE INVENTION

This invention relates to a process for the production of copper or copper base alloys. In particular, the invention relates to a process for the production of copper or copper base alloys that can provide surfaces having improved characteristics suitable for the production of various types of electrical parts, such as, a surface exhibiting decreased abrasion loss or a decreased coefficient of friction during insertion and drawing, for example, a surface of a multi-pin connector used for electric wiring in an automobile production; a surface of a charging-socket of an electric automobile which is used repeatedly a great number of times in insertion and drawing; a surface of a brush which is used in contact with a rotating body such as an electric motor and therefore is required to be highly resistant to abrasion; and a surface of a battery terminal which is also required to be resistant to abrasion and corrosion.

With the recent development of the electronics industry, electric wiring in various machines is becoming more and more complicated and highly integrated, and this has caused use of connectors having an increased number of pins. Conventional connectors having Sn-plated surfaces have encountered a problem in that the practical use thereof is becoming more and more difficult because of the increased friction at the times of insertion and drawing.

Currently available electric automobiles require charging at least once a day. Thus, it is necessary that a charging-socket is highly resistant to abrasion. In addition, since a large amount of electric current such as 10 A or more flows in sockets and therefore a large amount of heat is generated, a new problem that Sn-plated surfaces of sockets obtained by a conventional method cannot withstand the delamination of the plated surface has occurred.

In order to reduce the force of insertion of Sn-plated multi-pin terminals or in order to secure increased resistance to abrasion or good adhesion property of an electrical part such as the above-mentioned charging-socket, the conventional technique has proposed a method which comprises enhancing the apparent hardness of such electrical part by forming a hard Ni-plated layer or alternatively forming a diffusion layer of Cu—Sn beneath the Sn-plated layer formed thereon.

However, the proposed method has drawbacks in that Ni-coating is expensive and provides poor workability.

Moreover, the proposal that the Cu—Sn diffusion layer is formed and then the Sn-plating is applied thereon requires extremely complicated steps which comprise a step of plating Sn on the copper or copper base alloy, followed by heat treatment to produce the Cu—Sn diffusion layer. This causes a cost problem, as well as poor adhesion and workability of the Sn-plated surface layer and therefore the proposal is not practical.

A deeper understanding has been acquired with respect to the fact that the above-stated problems cannot be solved by the conventional surface treatment method. A method of the kind of the present invention was also among the conventional methods, which comprises the steps of subjecting copper or a copper alloy to plating treatment followed by heat treating the plated metal to cause heat diffusion of the base metal into the plated layer formed on the base material. However, the conventional method was no more than the method for only preventing the separation or peeling off, due to the influence of working or heat, of the surface treated layer from the metal body by making use of the diffusion between the surface treated layer and the matrix. For this reason, the stated problems could not be solved by said prior art method.

The present invention has been accomplished to solve the above-mentioned problems, and provides a method for producing copper or a copper base alloy which is excellent in surface hardness, contact resistance, bending workability, adhesion and terminal insertion/drawing force. Particularly, the invention relates to a process for producing a connector material which can respond to the recent requirement of dense packing of electrical parts such as those used in automobiles, or the like electrical parts which require resistance to abrasion and corrosion.

The present invention has solved the above-mentioned problems and provides a process for producing copper or a copper base alloy having a surface which is suitable when used as a connector or as a charging-socket of an electric automobile because of its having a low coefficient of friction and high resistance to abrasion, said process comprising coating the surface of copper or a copper base alloy with Sn or a Sn-alloy followed by applying heat treatment to the coated surface, thereby forming in the surface treated layer on said copper or copper base alloy an extremely hard Cu—Sn system intermetallic compound (such as $Cu_3Sn$, $Cu_4Sn$, $Cu_6Sn_5$, etc., or a compound having a formula such as Cu—Sn—X, wherein X is an addition element contained in said copper base alloy) as well as forming on said heat treated surface an oxide film having a restricted thickness. The present invention also relates to a process for producing electrical parts made of said copper or copper base alloys.

The present invention has been accomplished based on the finding that the surface hardness and contact resistance can be improved greatly by providing a specified thickness of a Sn layer on copper or a copper base alloy and also utilizing specified heat treating conditions. By doing this, Cu—Sn system intermetallic compound (such as $Cu_3Sn$, $Cu_4Sn$, $Cu_6Sn_5$, etc.) which is excellent in the surface hardness and contact resistance and an oxide film having a restricted thickness can be positively formed. As a result, the surface hardness can be increased to a level of $H_v$ 250 or more, preferably $H_v$ 300 or more. This hardness is considerably high as compared with the surface hardness of the plated-Sn layer ($H_v$, 60~120) and the hardness of the base material ($H_v$ 80~250). The additional finding which has contributed to the attainment of the present invention is that if an oxide film of an appropriate thickness is formed on the heat treated surface, superior sliding property can be obtained. Based on these findings the present inventors have successfully provided copper or copper base alloys having electrical and working characteristics suitable for use as connectors of automobiles or charging-sockets of electric automobiles and also having a surface having a small coefficient of friction as well as having improved resistance to abrasion.

In one aspect, the present invention provides a process for the production of coated copper or a coated copper base alloy comprising the steps of coating copper or a copper base alloy with Sn and subsequently heat treating the coated copper or copper base alloy in an atmosphere having the oxygen content of no more than 5%, thereby forming on the outermost surface thereof an oxide film and also a layer of an intermetallic compound mainly comprising Cu—Sn beneath said oxide film.

In the second aspect, the invention provides a process for the production of coated copper or a coated copper base alloy comprising the steps of coating copper or a copper base alloy with Sn and subsequently heat treating the coated copper or copper base alloy in an atmosphere having the oxygen content of no more than 5%, thereby forming on the outermost surface thereof an oxide film having a thickness of 10–1000 nm and a layer of an intermetallic compound mainly comprising Cu—Sn beneath said oxide film.

In the third aspect, the invention provides a process for the production of coated copper or a coated copper base alloy comprising the steps of coating copper or a copper base alloy with Sn and subsequently heat treating the coated copper or copper base alloy in an atmosphere having the oxygen content of no more than 5%, thereby forming on the outermost surface thereof an oxide film having a thickness of 10–1000 nm and a layer of an intermetallic compound mainly comprising Cu—Sn and having a thickness of 0.1–10 $\mu$m beneath said oxide film.

In the fourth aspect, the invention provides a process for the production of coated copper or a coated copper alloy as defined in any of the first to the third aspects mentioned above, wherein said heat treatment for forming the intermetallic compound mainly comprising Cu—Sn is conducted at a temperature in the range of 100–700° C. and for a time period in the range of 1 minute to 24 hours.

In the fifth aspect, the invention provides a process for the production of coated copper or a coated copper base alloy as defined in the fourth aspect mentioned above, wherein said heat treatment is first carried out in an atmosphere having the oxygen content of no less than 5% until the temperature reaches 100° C. and then the heat treatment is carried out in an atmosphere having the oxygen content of no more than 5% while the temperature is 100° C. or higher.

In the sixth aspect, the invention provides a process for the production of coated copper or a coated copper base alloy as defined in any of said first to fifth aspect, wherein said coating of Sn is provided by electroplating.

In the seventh aspect, the invention provides a process for the production of coated copper or a coated copper base alloy as defined in any of said first to sixth aspect, wherein said coating of Sn is provided by the electroplating followed by reflow treating.

In the eighth aspect, the invention provides a process for the production of a terminal or an electrical part comprising the steps of coating copper or a copper base alloy with Sn and then, during or after shaping the coated copper or copper base alloy into a terminal or the like electrical part, heat treating the coated copper or copper base alloy in an atmosphere having the oxygen content of no more than 5%, thereby forming on the outermost surface thereof an oxide film having a thickness of 10–1000 nm and a layer of an intermetallic compound mainly comprising Cu—Sn beneath said oxide layer.

In further aspect, the invention provides copper or a copper base alloy prepared by any of the above mentioned processes.

In still further aspect, the present invention provides a terminal or an electrical part prepared by any of the above mentioned processes.

According to the process of the present invention, a plated Sn coating is first formed on the surface of a base material consisting of copper or a copper base alloy by means of electroplating and the thus coated copper or copper base alloy can be heat treated, with or without the application of reflow treating, in an atmosphere preferably having a controlled oxygen content, thereby forming on the plated surface of the base material an oxide film having a desired thickness and at the same time a layer of Cu—Sn intermetallic compound beneath said oxide film by causing mutual diffusion between Cu or addition elements contained in the base material and Sn in the plated coating.

DETAILED DESCRIPTION THE INVENTION

Figure 1:
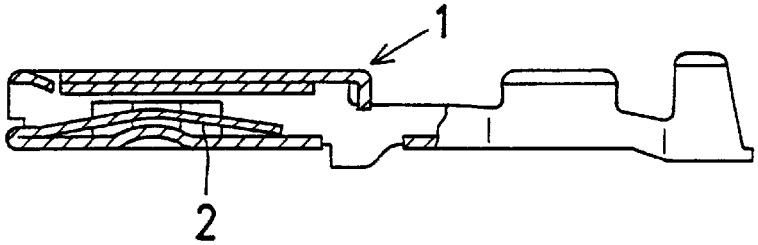
FIG. 1 is a schematic side view partially having cross sections of a female connector terminal having a spring portion made of the coated Cu alloy of the present invention.

The content of the present invention will be described below in detail, referring to the criticality of the compositional ranges of alloy elements and other numerical restrictions.

As regards the thickness of the Sn coating, the reason for restriction is as follows.

If the thickness of Sn coating before the heat treatment is less than 0.1 $\mu$m, there will be a loss of resistance to corrosion even after the heat diffusion. Particularly, corrosion by $H_2S$ or $SO_2$ or corrosion due to gaseous $NH_3$ in the presence of moisture may sometimes become a serious problem. If the thickness of Sn coating exceeds 10 $\mu$m, the diffusion layer will become too thick to prevent cracking during the step of working. As is represented by the stated trouble, the decrease in formability and workability is observed. In addition, fatigue characteristics will decrease and the problem of economical disadvantage will occur. Accordingly, the thickness of Sn coating is specified to range from 0.1 to 10 $\mu$m, more preferably from 0.3 to 5 $\mu$m.

A pretreatment such as Cu plating may be applied beneath Sn coating. The Cu layer beneath Sn coating serves to form Cu—Sn system intermetallic compounds and is effective in preventing an excessive diffusion of added elements contained in the base material alloy. If the Cu layer beneath Sn coating is too thick, the diffusion layer will become too thick, thus deteriorating workability of the alloy. Therefore, the preferred thickness of the Cu layer beneath Sn coating should be 10 $\mu$m or less, more preferably 3 $\mu$m or less. If this Cu layer beneath Sn coating is used, metals other than copper alloys such as steel material, stainless steel and aluminum alloys can also be used as a base material. Considering the fact that the metals should have characteristic properties desired for use in electrical parts, copper or copper base alloys are the most preferred. By utilizing such metals as base materials and forming on the surface thereof a layer resistant to abrasion according to the method of the present invention, products useful as electrical parts having a contact resistance in the range of no more than 60 m$\Omega$ can be obtained easily.

Considering the required strength, elasticity, electric conductivity, workability, resistance to corrosion or the like characteristic properties, the copper base alloys of the present invention can be prepared by the addition of at least one element selected from the group consisting of:

Zn: 0.01–40 wt %,

Sn: 0.1–10 wt %,

Fe: 0.01–5 wt %,

Ni: 0.01–10 wt %,

Co: 0.01–5 wt %,

Ti: 0.01–5 wt %,

Mg: 0.01–3 wt %,

Zr: 0.01–3 wt %,

Ca: 0.01–1 wt %,

Si: 0.01–3 wt %,
Mn: 0.01–10 wt %,
Cd: 0.01–5 wt %,
Al: 0.01–10 wt %,
Pb: 0.01–5 wt %,
Bi: 0.01–5 wt %,
Be: 0.01–3 wt %,
Te: 0.01–1 wt %,
Y: 0.01–5 wt %,
La: 0.01–5 wt %,
Cr: 0.01–5 wt %,
Ce: 0.01–5 wt %,
Au: 0.01–5 wt %,
Ag: 0.01–5 wt %, and
P: 0.005–0.5 wt %.

Said at least one of the element is added to copper in a total amount of 0.01–40 wt %.

As regards the means to form Sn coating, electrical plating and molten metal dipping are preferred in order to obtain a strongly adhered uniform coating layer most economically. If a thin and uniform coating layer is desired, electrical plating is preferred. As regards Sn to be used for coating, a Sn—Pb alloy whose Sn content is 5% or more can also be used. If the Pb content exceeds 95%, it will be difficult to obtain a required hardness, sliding property and a small insertion force because of the presence of Pb in the surface layer after heat diffusion. If the reflow treating is effected after the formation of Sn coating, the surface after the heat diffusion will exhibit improved smoothness and uniformity. Thus, preferably, the reflow treating should be conducted.

The thickness of an oxide film to be formed on the outermost surface is specified to range from 10 to 1000 nm. If the thickness of the oxide film is less than 10 nm, the sliding property decreases and adhesion wear is easy to occur. Thus, the force needed to insert a terminal increases. If the thickness of the oxide film on the outermost surface exceeds 1000 nm, the contact resistance will increase or it will become extremely unstable to impair electrical capabilities. In addition, the adhesion of the oxide film will be impaired so much that it is peeled off in the subsequent working. The thickness of the oxide film is, more preferably, in the range of 15–300 nm. The oxide film can be any of tin oxide and the compounds represented by the formulas, Cu—Sn—O, Cu—Sn—X—O and X—O, wherein X is an addition element contained in copper base alloys. No special limitations are required to the proportions of the respective components.

The above-mentioned oxide film can be applied to either one or both of female and male terminals of electrical parts, if such application is required. Moreover, it can also be applied to only the necessary portion of the electrical parts. It is important that these oxide films be formed on the surface of the hard diffusion layer mainly comprising Cu—Sn. An oxide film simply formed on the surface of a conventional Sn coating will not exhibit the above-mentioned effects.

Heat treatment should be effected in an atmosphere whose oxygen content is 5% or less. If heating is effected in an atmosphere whose oxygen content exceeds 5%, it will be difficult to control the operational conditions so that a uniform oxide film having the desired thickness can be obtained. Moreover, it is more preferred to control the oxygen content of the atmosphere to become 1% or less, because the thickness, minuteness and uniformity of the resulting oxide film is increased.

It is only an appropriate oxygen content in the atmosphere of heat treatment that is necessary to obtain the desired thickness of an oxide film during the time of heat diffusion. As regards components of the atmosphere other than oxygen, any one or two or more of other components can be used without any limitation. If a reducing atmosphere is needed, an atmosphere containing $H_2$, a CO gas, etc., can be used. If an inert atmosphere is needed, an atmosphere mainly comprising at least one inert gas selected from the group consisting of $N_2$, Ar and $CO_2$ gases which are readily available and inexpensive can be used advantageously. If it is desired to employ a reducing atmosphere, attention must be paid not only to the temperature and time period but also to the kind of gas to be used and the partial pressure thereof, because at a high temperature there may be a case wherein an oxide film is reduced.

There is also a case in which the oxygen of an oxide film formed before heat diffusion or the oxygen taken into the inside of the oxide film can be used for the formation of the desired oxide film or alternatively an oxide film formed by the mutual reaction of moisture contained in the atmosphere can be used as the desired oxide film. In such cases it is possible to make the atmosphere completely inert during the time of heat diffusion. In these cases, using an inert gas such as $N_2$ and Ar is also advantageous from an economical viewpoint.

Furthermore, it is also possible to utilize an oxide film which is formed as a result of time elapse after heat diffusion. In such a case, however, it will be difficult to obtain an oxide film which is uniform over the entire length or over the entire surface of the aimed product. Accordingly, the oxide film should preferably be formed, as already mentioned, at the same time as the time of causing heat diffusion.

As regards the heat treatment during the time of causing heat diffusion, it will be more preferred to effect the heat treatment in an atmosphere whose oxygen content is no less than 5% while the temperature is in the range of from room temperature to 100° C. and then to effect the heat treatment in an atmosphere whose oxygen content is 5% or less while the temperature is in the range of 100° C. or higher. If an oxide layer is formed at a temperature of 100° C. or less, it will readily become minute and uniform. If the oxygen content is 5% or less, however, it will take too much time before the desired oxide film is obtained, and therefore it is not economical to do so. For this reason, it is preferred to effect heat treatment in an atmosphere whose oxygen content is 5% or more at temperatures of up to 100° C. When the temperature exceeds 100° C., an oxide layer will rapidly grow into a thick layer when the oxygen content of the atmosphere exceeds 5%. Thus, it becomes difficult to obtain an oxide layer which is minute and uniform. Therefore, the oxygen content should preferably be set at 5% or less, more preferably 1% or less, if the temperature is 100° C. or more.

Conditions of heat treatment will be explained below. The heat treatment for obtaining the desired Cu—Sn diffusion layer and the oxide film formed thereon can be conducted at a temperature within the range of 100–700° C. for a time period of from 1 minute to 24 hours. At a temperature of less than 100° C., time required to effect heat diffusion will become too long and therefore it is not economical to do so. If the temperature exceeds 700° C., it will be difficult to obtain the temperature profile for the formation of the Cu—Sn diffusion layer. In particular, the melting point of Sn is 232° C., and therefore if the temperature is not raised along the mild temperature-raising curve, Sn will melt and cause the unevenness of the surface. However, if the raising of temperature is effected at higher temperatures, there will be an advantage that the time required for the diffusion can be shortened, and it is economically favorable to effect the heat treatment at higher temperatures. For this reason, the upper limit of the temperature is set to be 700° C. It is also possible to effect heat treatment at a stage where electrical parts such as a terminal are being shaped or at a stage after said shaping to obtain the desired Cu—Sn diffusion layer and the oxide film formed thereon. This case is more advantageous than the case where the heat treatment is effected before the shaping, because the abrasion loss of a metal mold will be decreased and also the spring characteristics will be enhanced because of the heat treatment which is applied after the shaping. Now, the embodiments of the practice of the present invention will be explained below by the working examples.

EXAMPLE 1

A base material (having a thickness of 0.25 mm) consisting of a copper alloy (Cu—1Ni—0.9Sn—0.05P) was coated with Sn (by the electroplating conducted in an electrolyte of sulfuric acid solution), followed by the heat treatment to cause the Cu—Sn diffusion.

Conditions for heat treatment to cause Cu—Sn diffusion (atmosphere, temperature and time) are shown in Table 1.

A number of samples having different thickness of Sn coating were prepared. The surfaces of these samples were reflow treated and conditions for heat treatment to cause Cu—Sn diffusion were controlled so as to form on the outermost surface thereof oxide layers having different thickness. In the method of No. 9, heat treatment for causing Cu—Sn diffusion was not carried out, but instead the conventional reflow treatment was conducted. The measurement of the thickness of an oxide film was effected by using the analyzers of AES (Auger Electron Spectroscopy) and ESCA (Electron Spectroscopy for Chemical Analysis).

TABLE 1

| | No. | Atmosphere | Temperature (° C.) | Time | Thickness of Sn Coating (nm) | Thickness of Oxide film (nm) |
|---|---|---|---|---|---|---|
| Method of the Present Invention | 1 | $N_2$ | 250 | 2 h | 1.5 | 20 |
| | 2 | room temp.-100° C.: air<br>100–300° C.: $N_2$ | 300 | 2.5 h | 1.1 | 30 |
| | 3 | 0.08% $O_2$, 2% CO balance $N_2$ + $CO_2$ | 300 | 4.0 h | 2.0 | 25 |
| | 4 | room tem.-100° C.: 0.5% $0_2$, balance Ar<br>100–200° C.: 0.2% $O_2$, balance Ar | 250 | 1 h | 4.1 | 20 |
| | 5 | 0.3% $O_2$, balance $N_2$ | 400 | 10 min. | 0.8 | 30 |
| | 6 | room temp.-100° C.: air<br>100–300° C.: 25% $H_2$ | 300 | 1 h | 0.7 | 18 |
| Comparative Method | 7 | air | 250 | 12 h | 3.2 | 3000 |
| | 8 | air | 400 | 3 h | 1.5 | 4000 |
| | 9 | no heat treatment | — | — | 1.4 | 6 |

Using the samples thus prepared, the tests for determining hardness, contact resistant and bending workability were conducted. The hardness test was effected in accordance with JIS-Z-2244. The contact resistance was measured in accordance with the four-terminal method by using the low-current/low-voltage measuring equipment. The maximum load placed on the Au-made contact shoe was varied in the range 0–20 gf to measure the resistance.

For evaluating the bending workability, a 90° W bend test was conducted (CES-M-0002-6, R=0.2 mm, in the directions both parallel and normal to the direction of rolling), followed by conducting the peeling test by using a tape. By doing this, both of workability and adhesion characteristic were determined. After the bending workability tests, samples were evaluated in accordance with the following criteria: samples having a satisfactory surface in the central ridge with no cracking and peeling were rated "○", those in which significant wrinkles occurred were rated "Δ", and those in which cracks or peelings occurred were rated "X".

The results of the above mentioned tests are shown in Table 2. In this connection, Comparative Method No. 10 was conducted in the same manner as in Example 1 except that the reflow treating was not conducted in the Comparative Method, and the surface roughness after the heat treatment were examined. The results shown in Table 3.

TABLE 2

| | No. | Surface hardness (Hv) | Contact Resistance (mΩ) | Bending Workability | Adhesion |
|---|---|---|---|---|---|
| Method of the Present Invention | 1 | 315 | 8 | ○ | ○ |
| | 2 | 340 | 8 | ○ | ○ |
| | 3 | 320 | 10 | ○ | ○ |
| | 4 | 310 | 10 | ○ | ○ |
| | 5 | 330 | 8 | ○ | ○ |
| | 6 | 310 | 7 | ○ | ○ |
| Comparative Method | 7 | 390 | 150 | Δ | X |
| | 8 | 360 | 90 | Δ | X |
| | 9 | 110 | 5 | ○ | ○ |

TABLE 3

| | No. | With Reflow Treating | Surface Roughness before Heat Treatment (μm) Ra | Surface Roughness before Heat Treatment (μm) Rmax | Surface Roughness after Heat Treatment (μm) Ra | Surface Roughness after Heat Treatment (μm) Rmax |
|---|---|---|---|---|---|---|
| Method of the present Invention | 1 | Yes | 0.05 | 0.68 | 0.07 | 0.90 |
| Comparative Method | 10 | No | 0.08 | 0.92 | 0.14 | 1.93 |

The results shown in Table 2 indicate that the copper or copper base alloys prepared by the methods of the present invention No. 1-No. 6 have markedly improved surface hardness and they are superior in contact resistance, bending workability and adhesion characteristic. Therefore, the alloy of the present invention proved to have superior characteristics as a copper alloy for use in fabricating connectors, charging-sockets sockets or the like. Moreover, Table 3 indicates that the alloy of No. 1 prepared by applying reflow treating after forming the plated Sn coating is superior, in the surface roughness measured after the heat diffusion, to the alloy of No.10 prepared by not applying reflow treating after the formation of plated Sn coating. Thus, it is proved that preferably reflow treating should be conducted after the formation of plated Sn coating.

In contrast, the alloys of Nos.7–8 prepared by heating in air have an increased thickness of an oxide film and exhibit increased contact resistance as well as decreased bending workability and decreased adhesion characteristic, and therefore, they are not suitable for use as electrical parts.

EXAMPLE 2

Figure 2:
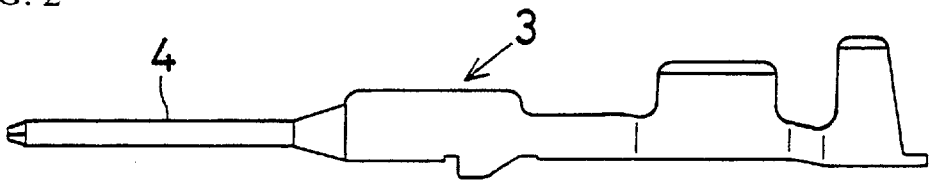
FIG. 2 is a schematic side view of a male connector having a tab portion made of the coated Cu alloy of the present invention.

The terminals shown in FIGS. 1 and 2 were prepared by conducting the heat treatment shown as No.1 in Table 1 to evaluate the suitability of the alloy for use as terminals. The heat treatment was effected after the fabrication of the terminals. FIG. 1 shows a side view of one example of female terminals having a spring portion 2 and FIG. 2 is a side view of a male terminal 3 having a tab portion 4.

As a comparative example, a terminal to which no heat treatment was applied after the fabrication thereof (which correspond to the method of No. 9 shown in Table 1 was prepared. The insertion force of the terminal and the electrical properties thereof were evaluated in order to examine if the improvement aimed at could be attained. The thickness of the Sn coating on the surface of the terminal at the time of each test is shown in Table 4.

TABLE 4

| | No. | With Heat Treatment | Thickness of Sn-Coating (nm) | Thickness of Oxide Film (nm) |
|---|---|---|---|---|
| Method of the present Invention | 1 | Yes | 1.5 | 20 |
| Comparative Method | 9 | No | 1.4 | 6 |

As regards the measurement of force of insertion, a male terminal as shown in FIG. 2 was inserted into a female terminal 1 at a rate of 10 mm/min. and the force of insertion was measured by a load cell.

Figure 3:
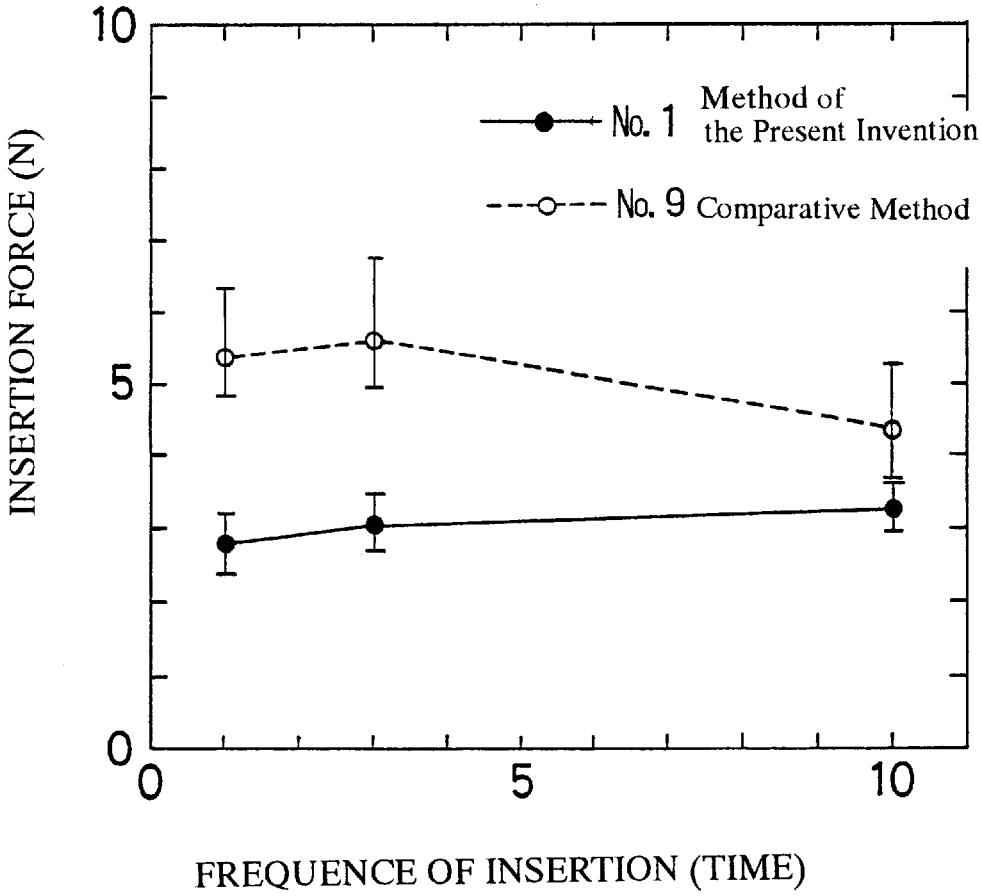
FIG. 3 is a graph showing the relationship between the number of repeated times of insertion (frequence of insertion) and the force needed for the insertion (insertion force).

The results of the measurements are shown in Table 5 and FIG. 3.

TABLE 5

| | No. | Times of Insertion | Force of Insertion (N) | Surface hardness (Hv) |
|---|---|---|---|---|
| Method of the present Invention | 1 | First time | 2.80 | 315 |
| | | Third time | 3.06 | |
| | | Tenth time | 3.19 | |
| Comparative Method | 9 | First time | 5.36 | 110 |
| | | Third time | 5.59 | |
| | | Tenth time | 4.28 | |

It is evident from Table 5 and FIG. 3 that when plated Sn-layer is reflow treated followed by heat treatment according to the method of the present invention, the force of insertion of a terminal is decreased in comparison with a conventional terminal and the scattering of the measurements is also decreased. Moreover, variation of the force of insertion is also decreased, i.e., the force of insertion is stable. This means that the terminal of the present invention is superior, in the resistance to abrasion, to the conventional terminals.

The low-voltage/low-current resistance after 10 times repeated insertion and drawing was measured in accordance with JIS-C-5402. The results of the measurement are shown in Table 6.

TABLE 6

| | No. | Initial Contact Resistance (mΩ) | Contact Resistance after 10 times Repeated Insertion and Drawing (mΩ) |
|---|---|---|---|
| Method of the Present Invention | 1 | 1.7 | 1.8 |
| Comparative Method | 9 | 1.5 | 1.8 |

Table 6 indicates that the terminal prepared by the method of the present invention exhibits good contact resistance comparable with that of the conventional terminal both in the initial resistance and in the after repeated use-contact resistance.

As explained in detail hereinbefore, the terminals obtained by the method of the present invention have remarkably reduced force of insertion without being increased in their resistance and therefore can be evaluated as terminals having superior resistance to abrasion.

EXAMPLE 3

A sample alloy was prepared by the Comparative Method No. 11 in which an alloy having the same composition as that used in No. 1 of Example 1 was coated with Sn in the same manner as in Example 1 followed by heat treatment but finally the resulting surface oxide film was removed. The force of insertion was measured with respect to the sample alloy obtained by the Comparative Method No. 11 in the same manner as in Example 2.

The results of the measurements are shown in Table 7.

TABLE 7

| | No. | Oxide Film (nm) | Force of Insertion (N) |
|---|---|---|---|
| Method of the Present Invention | 1 | 20 | 2.80 |
| Comparative Method | 11 | 5 | 3.17 |

Table 7 indicates that by obtaining on the surface of a terminal an oxide film having a specific thickness defined in the present invention, the sliding property of the terminal is increased and the force of insertion of the terminal is reduced.

As is obvious from the results of the examples, the copper or copper base alloys having plated Sn coating prepared by the method of the present invention have superiority in the surface hardness, contact resistance, bending workability, adhesion and force of insertion, and therefore superior materials as a connector material which can correspond to the current trend toward the high degree packing of electrical parts in the automobile production or as materials for use as electrical parts which require resistance to abrasion and corrosion.

What is claimed is:

1. A process for the production of copper or a copper base alloy comprising coating copper or a copper base alloy with Sn, followed by heat treating the resulting Sn-plated copper or copper base alloy in an atmosphere having an oxygen content of no more than 5%, thereby forming on an outermost surface thereof an oxide film and beneath said surface a layer of an intermetallic compound mainly comprising Cu—Sn.

2. The process for the production of copper or a copper base alloy according to claim 1, wherein the oxide film has a thickness of 15 to 300 nm and the oxygen content is not more than 1%.

3. The process for the production of copper or a copper base alloy according to claim 2, wherein the heat treating is carried out at a temperature of room temperature to 100° C.

4. A process for the production of copper or a copper base alloy comprising coating copper or a copper base alloy with Sn, followed by heat treating the resulting Sn-plated copper or copper base alloy in an atmosphere having an oxygen content of 5% or less, thereby forming on an outermost surface thereof an oxide film 10–1000 nm thick and beneath said surface a layer of an intermetallic compound mainly comprising Cu—Sn.

5. A process for the production of copper or a copper base alloy comprising coating copper or a copper base alloy with Sn, followed by heat treating the resulting Sn-plated copper or copper base alloy in an atmosphere having an oxygen content of 5% or less, thereby forming on an outermost surface thereof an oxide film 10–1000 nm thick and beneath said surface a layer 0.1–10 $\mu$m thick of an intermetallic compound mainly comprising Cu—Sn.

6. The process for the production of copper or a copper base alloy according to any one of claims 1, 4 or 5, wherein the heat treatment for forming the layer of intermetallic compound mainly comprising Cu—Sn is conducted at a temperature in the range of 100–700° C. and for a time period in the range of 1 minute to 24 hours.

7. The process for the production of copper or a copper base alloy according to claim 6, wherein the heat treatment for forming the layer of an intermetallic compound mainly comprising Cu—Sn is conducted first in an atmosphere whose oxygen content is no less than 5%, until the temperature reaches 100° C., and then in an atmosphere whose oxygen content is no more than 5%, while the temperature is 100° C. or higher.

8. The process for the production of copper or a copper base alloy according to claim 7, wherein said coating of Sn is provided by electroplating, followed by reflow treating.

9. The process for the production of copper or a copper base alloy according to claim 6, wherein said coating of Sn is provided by of electroplating.

10. The process for the production of copper or a copper base alloy according to claim 6, where in said coating of Sn is provided by electroplating, followed by reflow treating.

11. The process for the production of copper or a copper base alloy according to one of claims 1, 4 or 5, wherein said coating of Sn is provided by electroplating, followed by reflow treating.

12. The process for the production of copper or a copper base alloy according to one of claims 1, 4, or 5, wherein said coating of Sn is provided by electroplating.

13. The process for the production of copper or a copper base alloy according to claim 12, wherein said coating of Sn is provided by said electroplating, followed by reflow treating.

14. A process for the production of a terminal or an electrical part comprising coating copper or a copper base alloy with Sn and then, during or after shaping the coated copper or copper base alloy into a terminal or other electrical part, heat treating the coated copper or copper base alloy in an atmosphere having an oxygen content of no more than 5%, thereby forming on an outermost surface thereof an oxide film 10–1000 nm thick and beneath said surface a layer of an intermetallic compound mainly comprising Cu—Sn.

* * * * *